US007282840B2

(12) United States Patent
Chih

(10) Patent No.: US 7,282,840 B2
(45) Date of Patent: Oct. 16, 2007

(54) MODULAR BALLASTS OF AQUARIUM

(76) Inventor: Chen Ming Chih, No. 229-7, Jhongjhengsan Road, Yingge Town, Taipei Hsien (TW)

( * ) Notice: Subject to any disclaimer, the term of this patent is extended or adjusted under 35 U.S.C. 154(b) by 315 days.

(21) Appl. No.: 11/056,256

(22) Filed: Feb. 14, 2005

(65) Prior Publication Data

US 2006/0181871 A1 Aug. 17, 2006

(51) Int. Cl.
*H01J 1/02* (2006.01)

(52) U.S. Cl. ..... 313/17; 362/217; 362/221; 362/225

(58) Field of Classification Search ..... 362/217, 362/221, 225, 260; 313/17
See application file for complete search history.

(56) References Cited

U.S. PATENT DOCUMENTS 2,342,570 A * 2/1944 Biller ..... 362/296
3,634,681 A * 1/1972 Johnson et al. ..... 362/216
5,727,871 A * 3/1998 Kotloff ..... 362/225

* cited by examiner

*Primary Examiner*—Vip Patel
(74) *Attorney, Agent, or Firm*—Troxell Law Office, PLLC

(57) ABSTRACT

Modular ballasts of an aquarium comprise a lampshade and a plurality of ballast modules, wherein a reflection plate and a plurality of lamps are mounted inside the lampshade. At least a socket locates on the backside or the top of the lampshade for holding the ballast modules that comprise housings and ballasts. The ballasts are fixed to the housings and the ballast modules are capable of coupling with the lampshade. Because the ballasts are coupled with the housings, the manufacturers are capable of assembling the ballasts efficiently and the consumers are capable of changing the ballasts simply by pulling out the ballast modules by themselves. Consequently, the consumers can install the ballasts by themselves so as to save the required time for the change adequately.

3 Claims, 5 Drawing Sheets

MODULAR BALLASTS OF AQUARIUM

FIELD OF THE INVENTION

The present invention relates to modular ballasts of an aquarium, and more particularly to modular ballasts that can be assembled and disassembled easily.

BACKGROUND OF THE INVENTION

As shown in FIG. 1, the conventional illumination structure of the aquarium comprises a lampshade 10, a reflection plate 20, lamps 30, and at least a ballast 40, wherein the light emitted from the lamps 30 is reflected and focused inside the aquarium by the reflection plate 20 for illumination. The general illumination structure comprises the ballast 40 locked thereon. When the ballast 40 is broken, the consumers must spend much more time on the change of the broken ballast 40. Accordingly, in reality, it is very inconvenient for the manufacturers to make the ballast.

SUMMARY OF THE INVENTION

In view of the drawbacks of the conventional illumination structure, the present invention discloses a modular ballast to replace the conventional illumination structure thereby achieving the requirement for the industrial utilization.

The main object of the present invention is to provide a modular ballast of an aquarium, wherein the ballast is coupled with a housing to constitute a ballast module. By use of the ballast module, the manufacturers are capable of assembling the ballast efficiently and the consumers are capable of changing the ballast simply by pulling out the ballast module by themselves. Consequently, the consumers can install the ballast by themselves so as to save the required time for the change adequately.

The other features and preferred embodiments of the present invention will now be described with reference to the accompanying drawings.

DETAILED DESCRIPTION OF THE PREFERRED EMBODIMENT

The detailed structural feature and the preferred embodiment of the present invention will now be described in detail with reference to the accompanying drawings.

Figure 1:
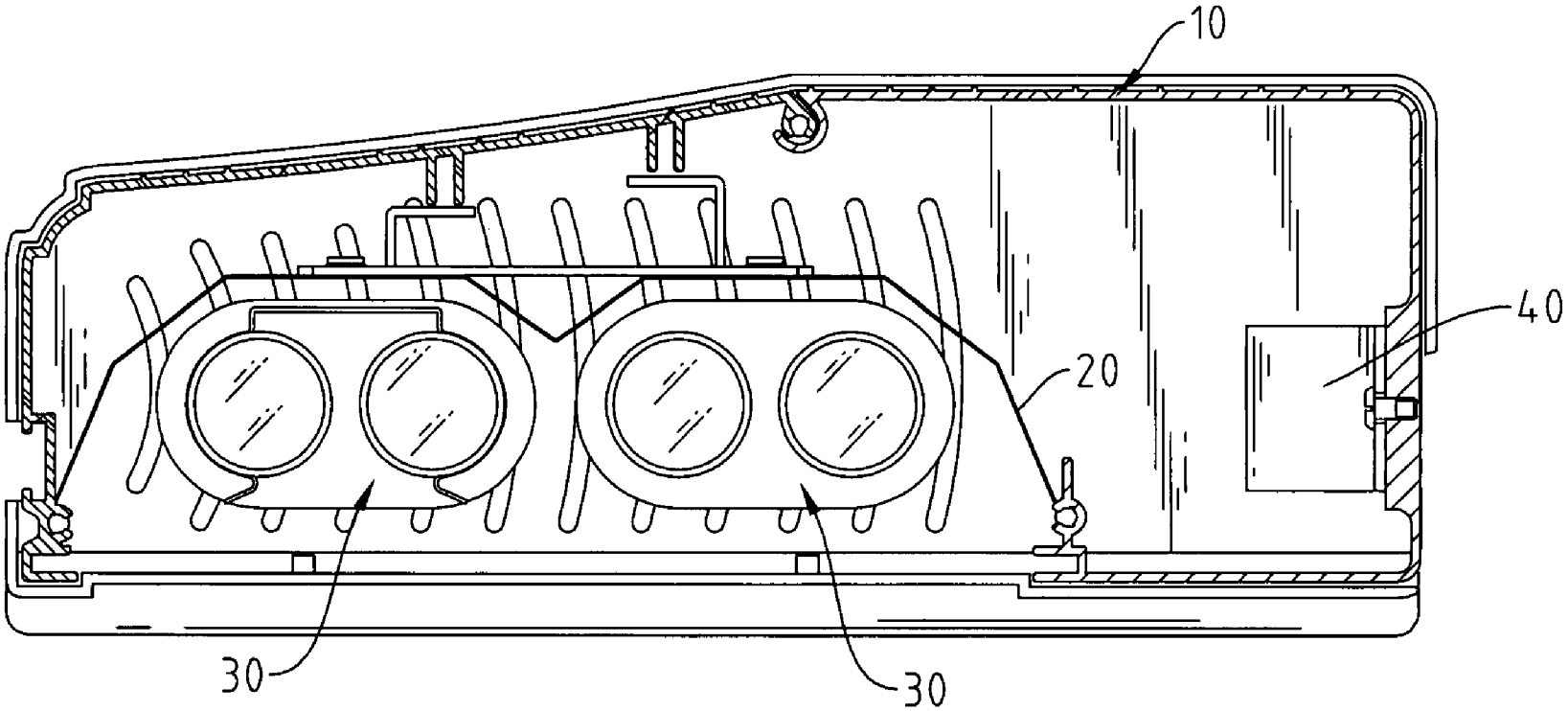
Fig. 1 Prior Art
FIG. 1 is a lateral view showing the assembly of the conventional illumination structure of the aquarium.
Figure 2:
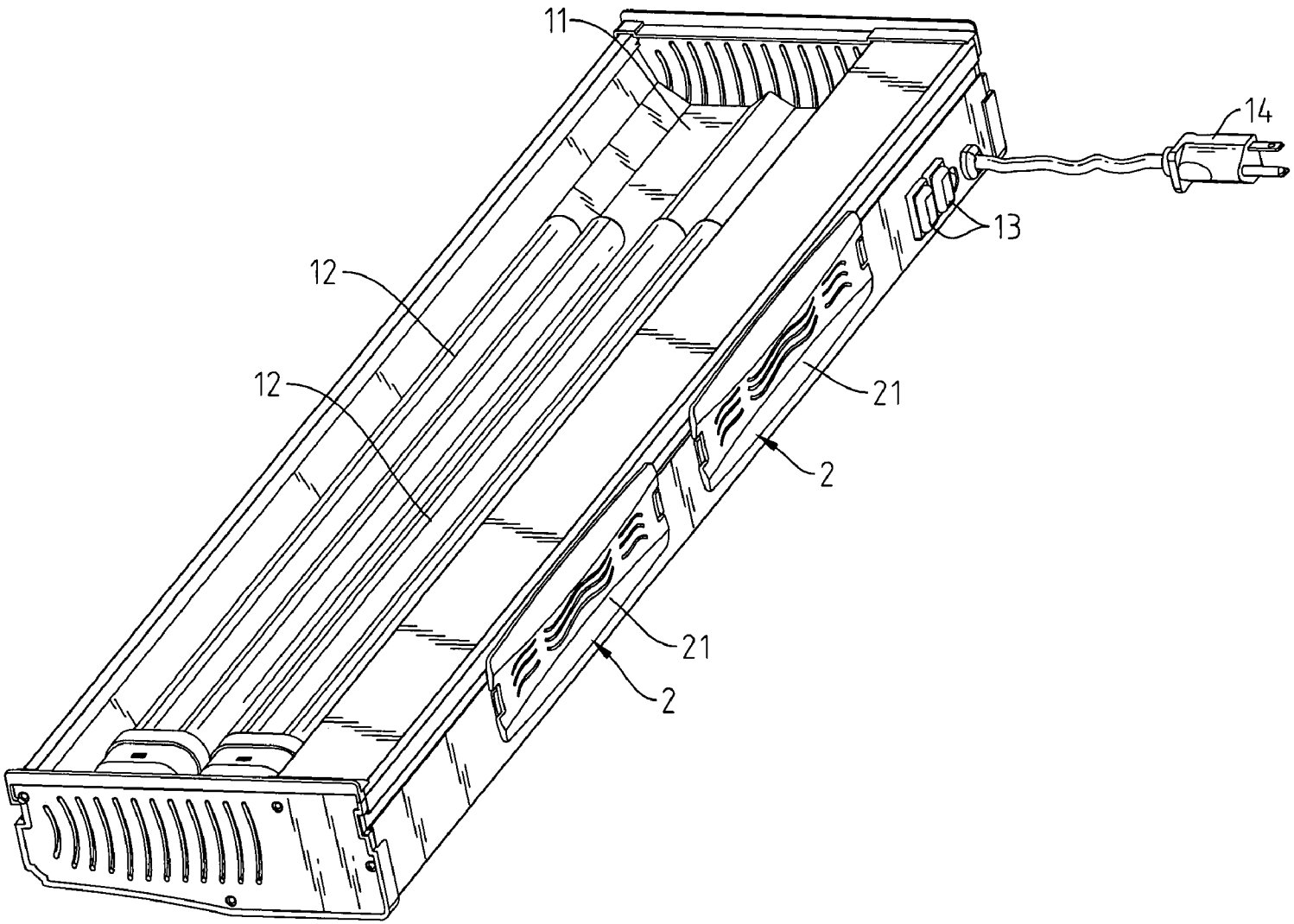
FIG. 2 is an elevational view showing the outward appearance of the present invention.
Figure 3:
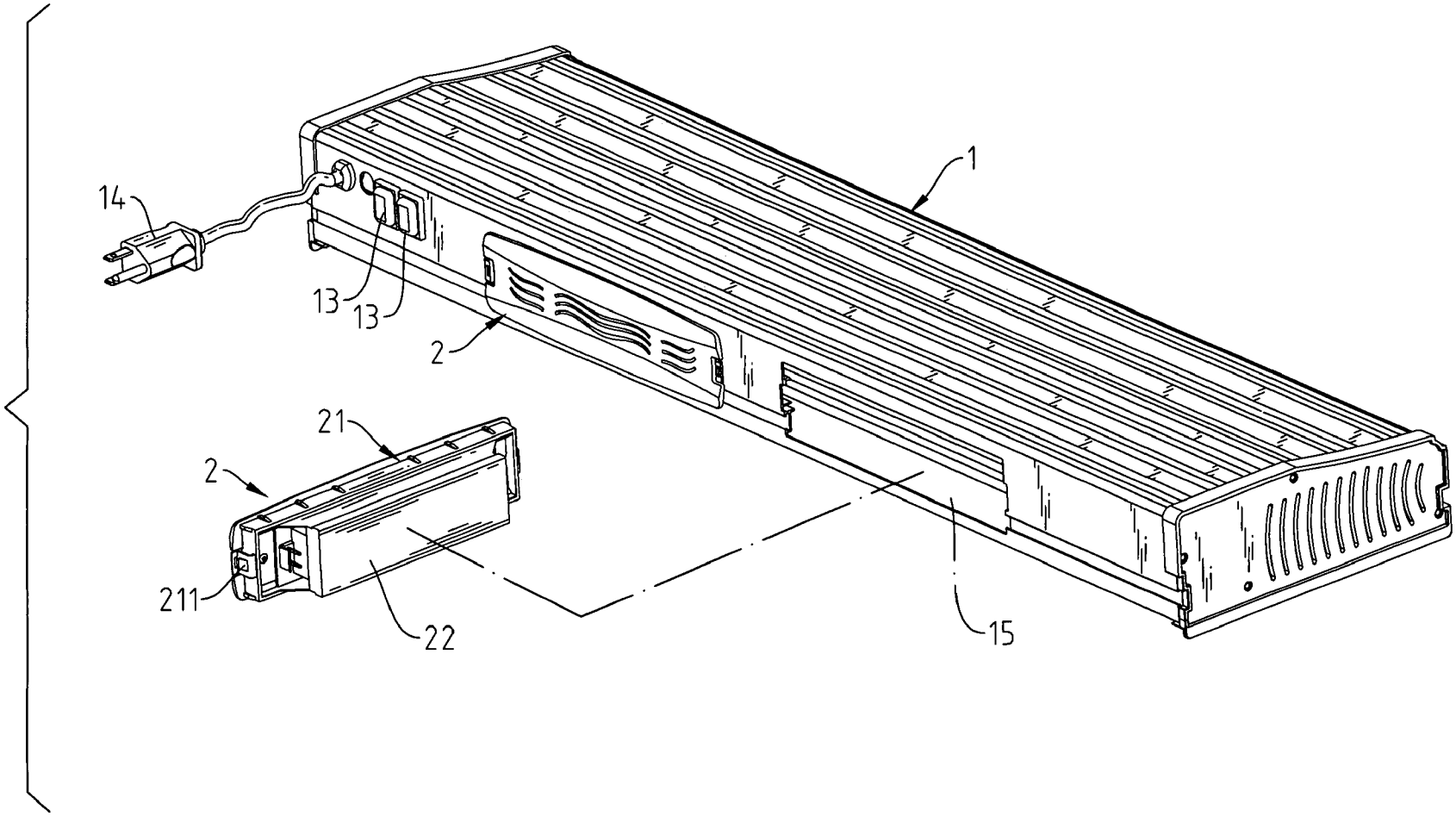
FIG. 3 is a partial decomposed, elevational view showing the present invention.
Figure 4:
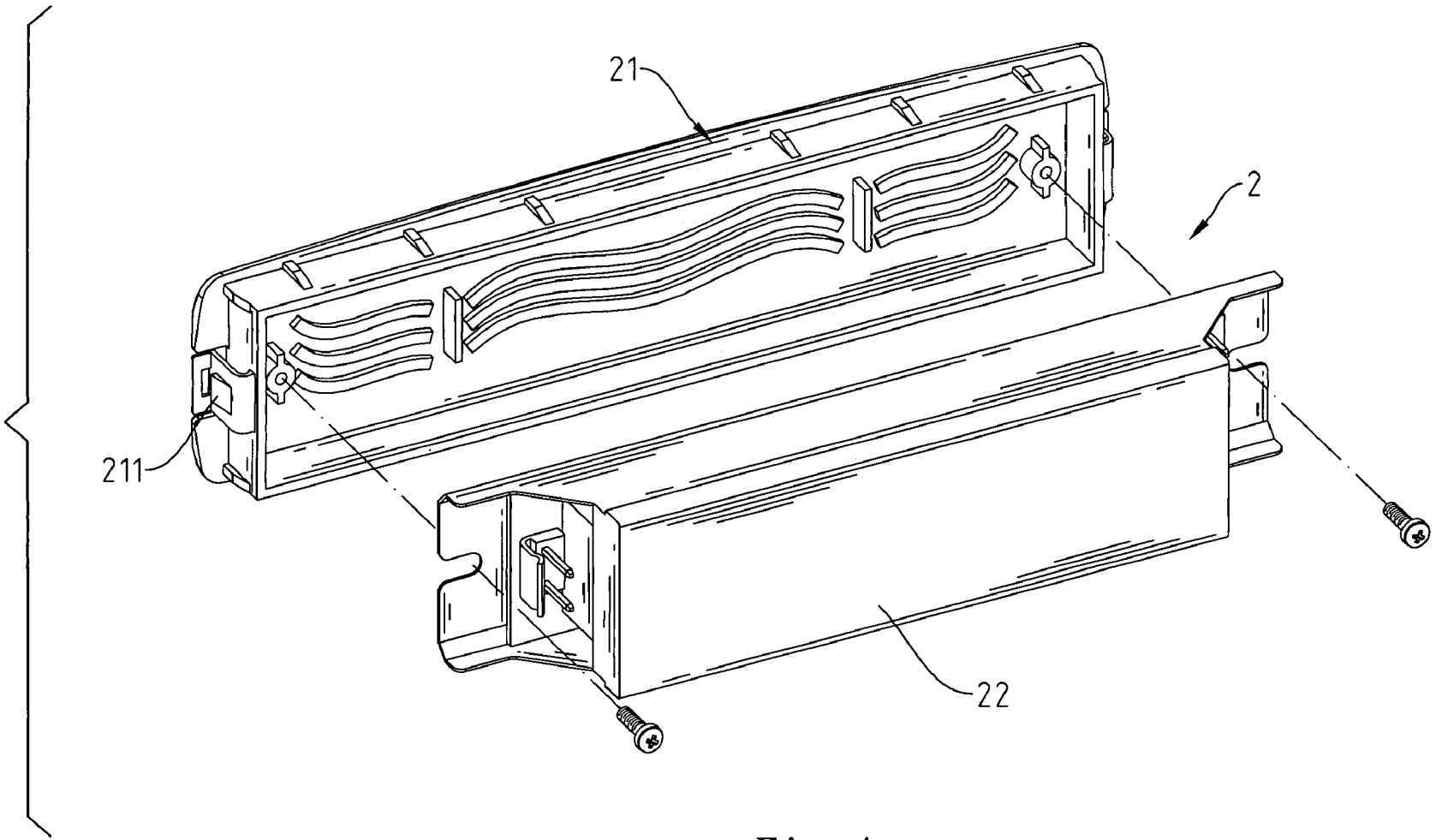
FIG. 4 is a decomposed, elevational view showing the modular ballasts of the present invention.

Referring to FIG. 2 through FIG. 4, modular ballasts of an aquarium of the present invention comprises a lampshade 1 and a plurality of ballast modules 2, wherein a reflection plate 11 is mounted inside the lampshade 1 and several lamps 12 are mounted below the reflection plate 11. A switch 13 and a plug 14 are mounted on the backside and the sidewall of the lampshade 1.

In order to facilitate the installation of the ballast modules 2, at least a socket 15 is formed on the backside of the lampshade 1 for holding the ballast modules 2. The ballast modules 2 comprise housings 21 and ballasts 22, wherein the ballasts 22 are fixed to the housings 21 and fasteners 211 are mounted on the sidewalls of the housings 21 to facilitate the connection between the ballast modules 2 and the lampshade 1. The ballast modules 2 can be installed easily since the housings 21 can be mounted inside the socket 15 simply by buckling the housings 21 of the ballast modules 2 into the socket 14 directly. Therefore, the assembly and the disassembly of the ballasts 22 can be carried out rapidly.

In the present invention, the ballast modules 2 can couple with the lampshade 1 by use of the fasteners 211 that mount on the sidewalls of the housings 21. Besides, the fasteners may be mounted on the lampshade 1 to fasten the connected ballast modules 2.

Figure 5:
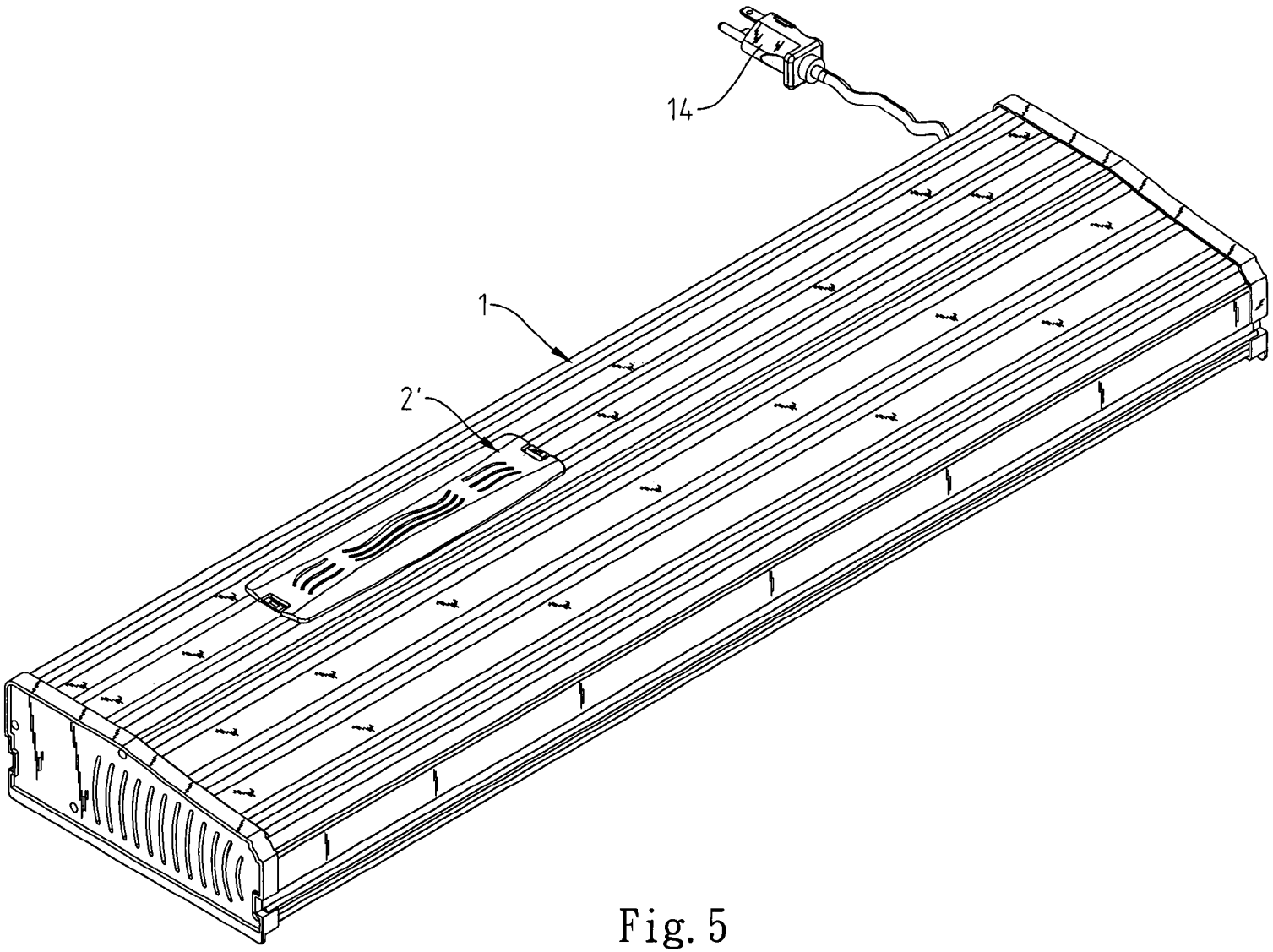
FIG. 5 is an elevational view showing the outward appearance of another preferred embodiment of the present invention.

In the above-mentioned preferred embodiment, the ballast modules 2 are mounted on the backside of the lampshade 1. However, as shown in FIG. 5, the ballast modules 2' can be mounted on the top of the lampshade 1 or other position of the lampshade 1.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What the invention claimed is:

1. A modular ballast structure for an aquarium comprising:

a lampshade forming a housing;

a reflection plate mounted inside the lampshade;

a plurality of lamps mounted inside the lampshade in a position underlying the reflection plate;

at least one ballast socket formed as an indentation in an exterior surface of the lampshade;

at least one removable ballast configured to selectively engage the at least one ballast socket by sliding into or out of the at least one ballast socket; and a plurality of fasteners for selectively fastening the at least one ballast into the at least one ballast socket.

2. The modular ballast structure of claim 1, wherein the a plurality of fasteners comprise a first buckle located on one side of the at least one ballast socket and a second buckle located on an opposite side of the at least one ballast socket.

3. The modular ballast structure of claim 1, wherein the at least one ballast socket comprises two ballast sockets and the at least one removable ballast comprises two removable ballasts.

* * * * *